US007905015B2

(12) United States Patent
Quenneville et al.

(10) Patent No.: US 7,905,015 B2
(45) Date of Patent: Mar. 15, 2011

(54) METHOD FOR TERMINATING A TELECOMMUNICATIONS CABLE

(75) Inventors: Alain Quenneville, Quebéc (CA); Michel Bohbot, Montreal (CA); Antoine Tazbaz, Québec (CA)

(73) Assignee: Belden CDT (Canada) Inc., Saint-Laurent (CA)

( * ) Notice: Subject to any disclaimer, the term of this patent is extended or adjusted under 35 U.S.C. 154(b) by 11 days.

(21) Appl. No.: 12/188,380

(22) Filed: Aug. 8, 2008

(65) Prior Publication Data

US 2008/0293305 A1 Nov. 27, 2008

Related U.S. Application Data

(62) Division of application No. 11/552,168, filed on Oct. 24, 2006, now Pat. No. 7,448,920, which is a division of application No. 10/853,566, filed on May 24, 2004, now Pat. No. 7,150,657.

(60) Provisional application No. 60/472,779, filed on May 23, 2003.

(30) Foreign Application Priority Data

May 23, 2003 (CA) ..... 2429765

(51) Int. Cl.
*H01R 43/00* (2006.01)
*H01R 24/00* (2006.01)

(52) U.S. Cl. ..... 29/854; 29/828; 29/857; 29/868; 29/869; 29/872; 439/660

(58) Field of Classification Search ..... 29/828, 29/829, 832, 835, 837, 838, 854, 857, 868, 29/869, 873, 872; 439/676, 660, 418, 488, 404, 741, 457; 361/827, 826; 174/102 R, 102 C, 101 R, 121 A
See application file for complete search history.

(56) References Cited

U.S. PATENT DOCUMENTS

| | | | | |
|---|---|---|---|---|
| 5,655,284 | A * | 8/1997 | Ferrill et al. | 29/566.3 |
| 5,899,770 | A | 5/1999 | Ezawa | |
| 5,969,295 | A | 10/1999 | Boucino et al. | |
| 6,338,642 | B2 | 1/2002 | Nicholls et al. | |
| 6,354,872 | B1 | 3/2002 | Lilienthal et al. | |
| 6,370,769 | B1 * | 4/2002 | Lilienthal, II | 29/861 |
| 6,371,793 | B1 * | 4/2002 | Doorhy et al. | 439/404 |
| 6,409,544 | B1 * | 6/2002 | Wu | 439/607.05 |
| 6,441,308 | B1 * | 8/2002 | Gagnon | 174/105 R |
| 6,488,525 | B2 * | 12/2002 | Abel et al. | 439/404 |

(Continued)

OTHER PUBLICATIONS

Category 6 Cabling: A Standards and Systems Overview; published by the Category 6 Consortium; CIM vol. 10 issue 5, May 2002, Market Trends by BSRIA, p. 1-8.

*Primary Examiner* — Derris H Banks
*Assistant Examiner* — Tai Nguyen
(74) *Attorney, Agent, or Firm* — Goudreau Gage Dubuc; Huge Mansfield

(57) ABSTRACT

A method for terminating a telecommunications cable where the cable comprises a plurality of twisted pairs of wires is disclosed. The method comprises providing an interconnection module comprising a pair of contacts for each of the twisted pairs, aligning the end portions and interconnecting each of the aligned end portions with a corresponding pair of conductive contacts. Aligning comprises arranging the end portions such that when connected to the contact pairs, the twisted pairs remain uncrossed.

18 Claims, 12 Drawing Sheets

U.S. PATENT DOCUMENTS

| | | | | |
|---|---|---|---|---|
| 6,558,204 | B1 | 5/2003 | Weatherley | |
| 6,579,116 | B2 * | 6/2003 | Brennan et al. | 439/418 |
| 6,783,402 | B2 | 8/2004 | Chen | |
| 6,811,445 | B2 | 11/2004 | Caveney et al. | |
| 6,830,488 | B2 | 12/2004 | Bush et al. | |
| 6,846,197 | B2 | 1/2005 | Hirokawa et al. | |
| 7,150,657 | B2 | 12/2006 | Quenneville | |
| 2003/0224666 | A1 | 12/2003 | Yuan-Huei | |
| 2007/0042635 | A1 | 2/2007 | Quenneville | |

* cited by examiner

METHOD FOR TERMINATING A TELECOMMUNICATIONS CABLE

CROSS REFERENCE TO RELATED APPLICATIONS

This application is a divisional of U.S. patent application Ser. No. 11/552,168 filed Oct. 24, 2006, (now U.S. Pat. No. 7,448,920), which is a divisional of U.S. patent application Ser. No. 10/853,566 filed May 24, 2004 (now U.S. Pat. No. 7,150,657), which claimed priority to U.S. Provisional App. No. 60/472,779 filed May 23, 2003.

FIELD OF THE INVENTION

The present invention relates to a wire lead guide which serves as a guide for wires between the end of the cable and a connector and a method for terminating a communications cable. In particular, the present invention relates to wire lead guide for arranging the individual twisted pairs of wires exiting the end of a telecommunications cable, their connection to a connector and the method of use of the wire lead guide in order to improve performance of the cable/connector assembly.

BACKGROUND

The development of the Category 6 standard (ANSI/TIA/EIA-568-B.2-1) and its subsequent wide acceptance by the telecommunications industry has raised the transmission requirements for electrical signals in telecommunications cables to a higher level than ever. Category 6 is a performance classification for twisted pair cables, connectors and systems which is specified up to 250 MHz.

In many installations, in particular office buildings and the like, telecommunications cables are installed behind walls or in the plenum ceiling and floor spaces. These cables are typically terminated at a first end in a patch bay close to servers or other networking equipment and terminated at a second end at a receptacle in proximity to the user. At both ends the individual wires emerging from the end of the cable are spliced into the back of an appropriate connector with the front side of the connector being exposed to provide easy access for the insertion and removal of patch cables. In order to test the installed cables to assess whether or not they meet the specifications as dictated by the applicable standards, a testing equipment is attached to the front of the connector located at the patch bay and the front of the connector located at the receptacle. Measurement of the performance of length of cable, therefore, includes not only the length of cable but also the connectors through which access to the cable is gained.

As higher transmission frequencies give rise to complex changes in the behaviour of the various components, not only the performance of the individual components, in this case the cable and the two connectors, is important but also the manner in which these components are interconnected. A number considerations should be taken into account when installing telecommunications cables in order to ensure that they will meet the requisite testing specifications following installation. In particular, the cable termination on the back of the connector is an important factor and the conduction of an installation in a casual manner can lead to a significant degradation of performance.

One important electrical characteristic by which the performance of a telecommunications cable is measured is Near-End-Crosstalk, or NEXT. As is well known in the art, crosstalk is the undesired coupling from signal carrying wire to a collocated signal carrying wire. Crosstalk gives rise to undesirable interference which can severely affect transmission performance. For its part, NEXT is a measurement of crosstalk between two wire pairs of wires and is measured as the difference in signal strength between the interfering pair and the interfered pair. NEXT is directly affected by the manner in which the cable is terminated, and arises when the wires of two pairs are crossed. Crossing of wires can arise due to a number of reasons including failure to take appropriate care during installation or physical forces brought to bear on the cable or connector, for example during the installation of other cables.

Additionally, failure to take appropriate care when stripping the jacket from the length of cable as well as untwisting the twisted pairs can create a loop which can also affect performance. Therefore, installation of the cable on the back of each connector becomes very sensitive to the manner in which the installation is carried out by the installer.

SUMMARY OF THE INVENTION

In order to address the above and other drawbacks, the present invention provides for a method for terminating a telecommunications cable where the cable comprises a plurality of twisted pairs of wires arranged in a generally parallel relationship to a common axis, each of the twisted pairs having an exposed end portion. The method comprises the steps providing an interconnection module comprising a pair of contacts for each of the twisted pairs, aligning the end portions and interconnecting each of the aligned end portions with a corresponding pair of conductive contacts. The aligning step comprises arranging the end portions such that when connected to the contact pairs, the twisted pairs remain uncrossed.

There is also described a wire lead guide for isolating the end portions of a plurality twisted pairs of wires where the twisted pairs arranged in a generally parallel relationship to a common axis and distributed around the common axis. The guide comprises a guide body and a plurality of non-intersecting passageways through the body. Each of the passageways is comprised of an entrance and an exit. The end portions of one of the twisted pairs are inserted through a corresponding one of the passageways. The passageways isolate the twisted pairs of wires from one another.

There is also disclosed a connector assembly for terminating a communications cable where the cable comprises a jacket encasing a plurality of twisted pairs of wires and wherein an end portion of each of the twisted pairs is exposed. The assembly comprises an interconnection module comprised of a plurality of pairs of contacts and adapted to interconnect with the end portions of the twisted pairs and a wire lead guide comprised of a guide body and a plurality of non-intersecting passageways through the body. The end portions are inserted through a corresponding one of the passageways prior to interconnection with a corresponding one of the pairs of contacts.

Additionally, there is disclosed a connector assembly for terminating a category 6 communications cable where the cable comprises a jacket encasing four twisted pairs of wires and wherein an end portion of each of the twisted pairs is exposed. The assembly comprises an interconnection module comprised of four of pairs of terminals, the pairs of terminals adapted to interconnect with the end portions of the twisted pairs. The assembly exhibits between subsequent installations a range of alien cross talk at 100 MHz between pairs of twisted pairs of less than 1.000 mV/V.

Furthermore there is disclosed a method of installing a category 6 communications cable, the cable comprising a jacket encasing four twisted pairs of wires and wherein an end portion of each of the twisted pairs is exposed. The method comprises the steps of providing an interconnection module comprising a pair of contacts for each of the twisted pairs, aligning the end portions; and interconnecting each of the aligned end portions with a corresponding pair of conductive terminals. The method exhibits over subsequent installations a range of alien cross talk at 100 MHz between pairs of twisted pairs of less than 1.000 mV/V.

DETAILED DESCRIPTION OF THE ILLUSTRATIVE EMBODIMENTS

Figure 1:
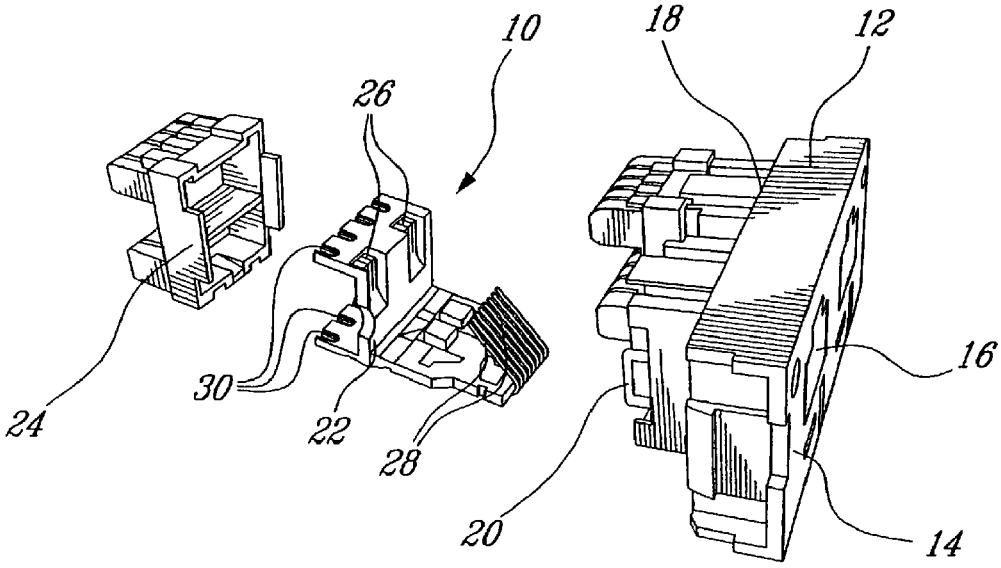
FIG. 1 is an exploded view (from the front) of a connector in accordance with an illustrative embodiment of the present invention.

Referring to FIG. 1, a connector assembly, generally referred to using the numeral 10, for insertion into a patch bay or receptacle cover (both not shown) is disclosed. The connector assembly 10 is typically comprised of a front plate 12 having moulded into its front side 14 a socket 16 into which a patch cable having the requisite connector plug (both not shown) can be inserted. The front plate is typically manufactured from a dielectric material which is easily cast such as plastic. Moulded into the rear side 18 of the front plate 12 is a receptacle 20 for receiving a snap in interconnection module 22 and snap on cover 24.

Note that although the socket 16 in the present illustrative embodiment is adapted to receive an RJ-45 type plug, sockets as in 16 having shapes adapted to receive other types of connectors are also within the scope of the present invention. Additionally, the connector assembly 10 could also be integrated into a patch panel (not shown) or form part of a connector assembly where the socket as in 16 is replaced by a BIX connector.

Figure 2:
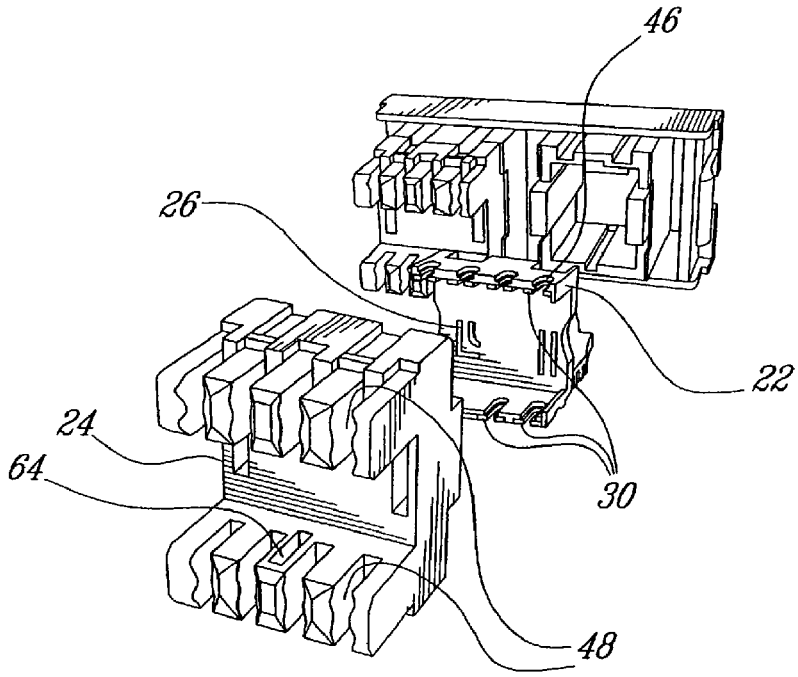
FIG. 2 is an exploded view (from the rear) of a connector in accordance with an illustrative embodiment of the present invention.

Referring to FIG. 2 in addition to FIG. 1, the interconnection module 22 for the ANSI/TIA/EIA-568-B.2-1 standard is comprised of a series of eight (8) conductors as in 26 which are each terminated at a first end by a straight bendable portion as in 28 and at a second end by insulation displacement contact (IDC) terminals as in 30, each having a bifurcated contact plate. Typically, the terminals 30 are arranged in two opposing parallel rows of four (4) terminals 30 each.

Figure 3:
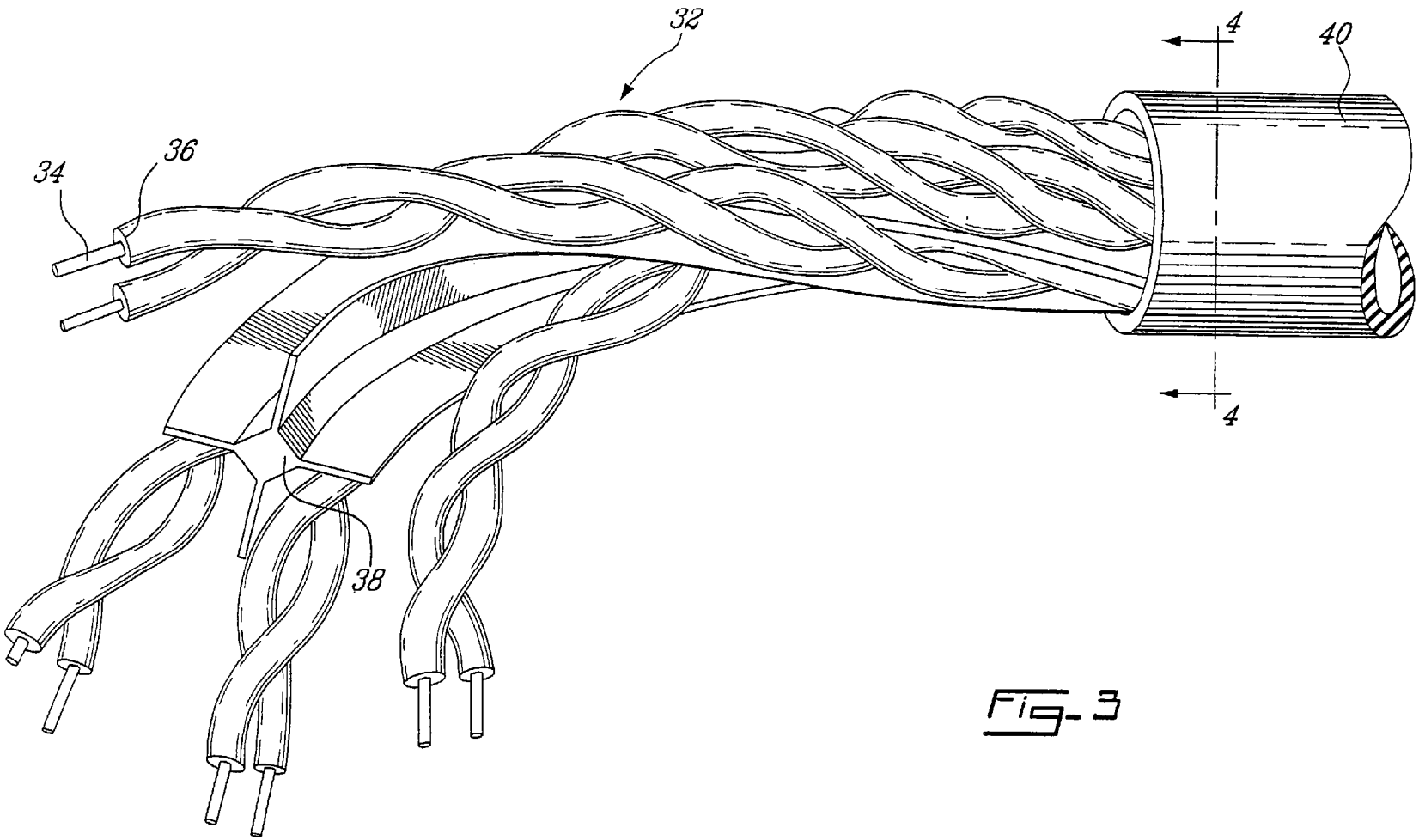
FIG. 3 is a perspective view of a communications cable having four pairs of twisted pair conductors in accordance with an illustrative embodiment of the present invention.

Referring to FIG. 3, a category 6 communications cable, in this case an Unshielded Twisted Pair (UTP) cable and generally referred to by the reference numeral 32, is disclosed. Category 6 cables have evolved from the lower performance Category 5 and Category 5e cabling systems, and consist of four (4) pairs of 18 to 26 AWG gauge wires as in 34 manufactured from suitable conducting material such as copper. Each wire 34 is individually wrapped in a colour coded outer sheath 36, typically manufactured from polyethylene (PE). As shown in FIG. 3, the two wires 34 of each pair are wound helically around one another to form the ubiquitous twisted pairs well known to persons of ordinary skill in the art. As stated above, twisted pairs significantly reduce the crosstalk which would otherwise arise as a result of the capacitive interference between two parallel transmission lines. Furthermore, as is also well known in the art, performance of a cable comprised of multiple twisted pairs of wires can be increased by varying the lay lengths of the twists between adjacent pairs (lay lengths typically range from 0.25 to about 1.5 inches for telecommunications cables).

Figure 4B:
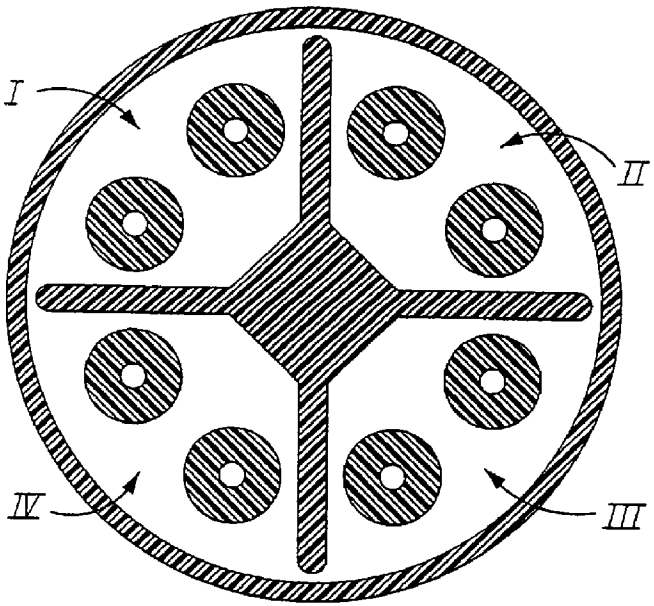
FIGS. 4*a* and 4*b* are cross sectional views of the cable of FIG. 1 taken across lines 4-4.
Figure 4A:
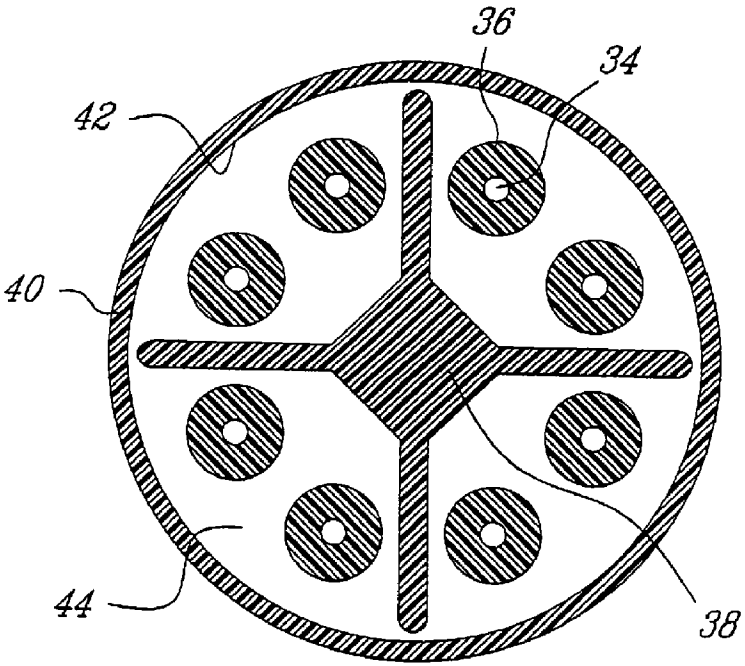

Category 6 cables may include an isolating separator 38 between each of the four (4) pairs of wires 34. The communications cable 32 also includes a cable jacket 40, typically manufactured from polyvinylchloride (PVC). As will be clear on referring to FIG. 4*a*, the isolating separator 38 divides the chamber defined by the inner wall 42 of the cable jacket 40 into a series of four compartments as in 44. Each compartment contains the two wires 34 belonging to one twisted pair. The isolating separator 38 is typically manufactured from a polymer material such as PVC or PE. The use of an isolating separator 38 further reduces cross talk thereby improving the performance characteristics of the cable.

Note that although the above illustrative embodiment makes reference to an Unshielded Twisted Pair (UTP) cable, the method and the wire lead guide could also be used in conjunction with other types if cables, for example Screened Twisted Pair (ScTP) cables or Shielded Twisted Pair (STP) cables in both round and flat configurations.

Referring back to FIG. 2, each bifurcated IDC terminal 30 has sharp opposed edges 46. As is well known to persons of ordinary skill in the art, pressing a sheathed wire (as in 34 in FIG. 3) into the bifurcation causes the sharp edges 46 to sever the outer sheath 36 thereby bringing the conductor as in 26 into electrical contact with the wire 34. On assembly, the interconnection module 22 is inserted into the cover 24 such that each terminal 30 is arranged proximally to a corresponding slot 48 in the cover 24.

Note that although the interconnection module 22 has been described hereinabove with reference to IDC type bifurcated terminals as in 30, other types of contacts are also foreseeable for use in the present invention including soldered contacts or self-cutting contacts for use in "tool less" implementations.

Figure 5:
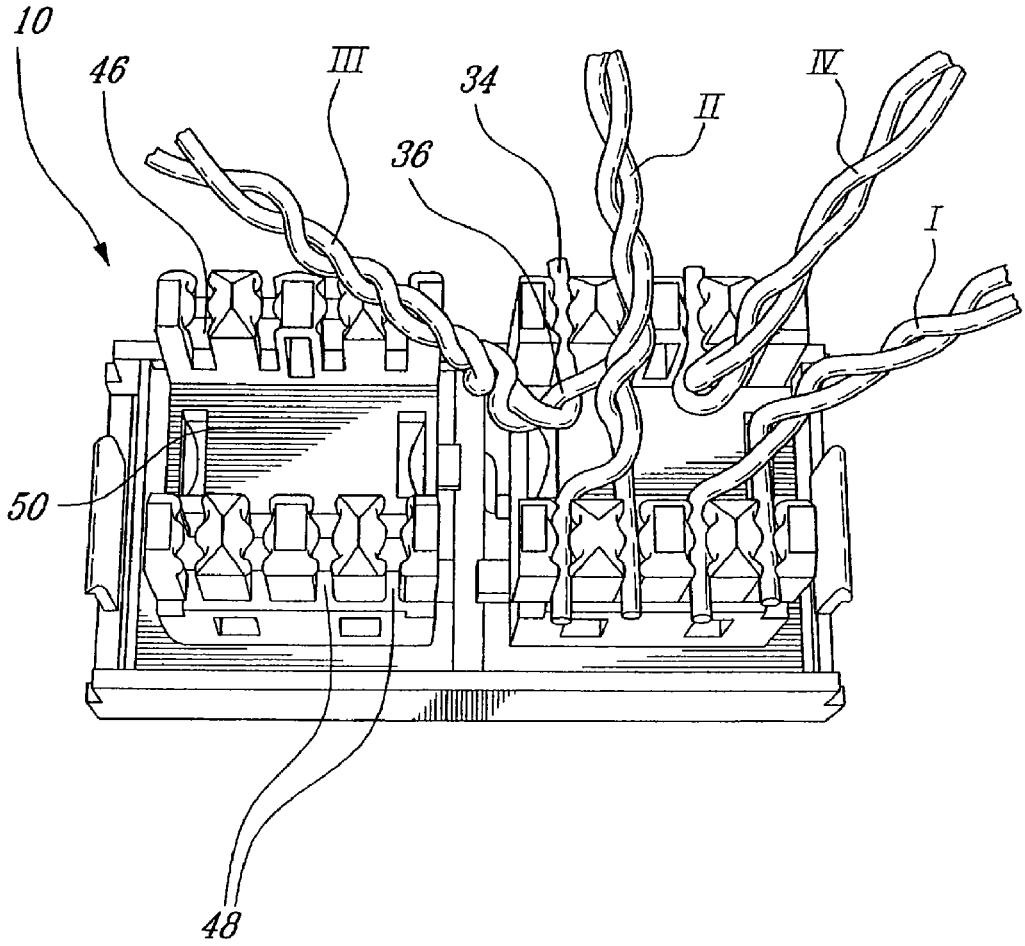
FIG. 5 is a perspective view (from the rear) of an assembled connector in accordance with an illustrative embodiment of the present invention.

Referring now to FIG. 5, once assembled, each slot 48 allows a wire as in 34 to be inserted between the sharp edges 46. Typically individual wires and their corresponding sheaths 36 are inserted between the sharp edges 46 of the bifurcated IDC terminal 30 by means of a suitable tool which simultaneously removes any excess from the end of the wire 34. A space 50 is provided for between the two rows of slots 48 to allow the wires 34 to be bent such that they may be pressed flat into the slots 48.

As is well known to those of ordinary skill in the art, the sheaths 36 of each wire are colour coded in order to aid the installer during installation of cables onto the connectors. ANSI/TIA/EIA-568 provides for four standardised colours, that is blue, orange, green and brown, for colour coding the sheaths 36 of the individual wires 34. As is also well known in the art, one wire 34 of each pair typically has a solid coloured sheath 36 while the second wire 34 of each pair has a white sheath 36 into which a stripe having the same colour as the other wire of the pair has been imbedded along the length thereof.

In fabricating a cable 32, the twisted pairs are distributed around the core of the cable such that if the cable 32 is cut in cross section the order of the twisted pairs is predetermined. The order as defined by ANSI/TIA/EIA-568 when looking at a first end of the cable and proceeding clockwise is blue, orange, green and then brown, or alternatively when looking from the other end the reverse, i.e. blue, brown, green and then orange. In this regard, referring now back to FIG. 4*b*, the twisted pairs are referenced using the numerals I, II, III and IV. Applying the order as defined in ANSI/TIA/EIA-568 the colours could be assigned to each twisted pair in the following manner: I—blue, II—orange, III—green and IV—brown or alternatively (if viewed from the other end) I—blue, II—brown, III—green and IV—orange.

Referring again to FIG. 5, the wires 34 of each twisted pair are inserted into adjacent slots according to the requirements of the particular standard being implemented. ANSI/TIA/EIA-568B, for example, requires that twisted pair I (blue) be inserted in the two slots 48 located in the right lower quadrant of the snap on cover 24, twisted pair II (orange) be inserted in the two slots 48 located left lower quadrant, twisted pair III (green) be inserted in the two slots 48 located left upper quadrant, and twisted pair IV (brown) be inserted in the two slots 48 located left lower quadrant. ANSI/TIA/EIA-568A, on the other hand, requires that the green and orange twisted pairs are reversed.

Figure 6:
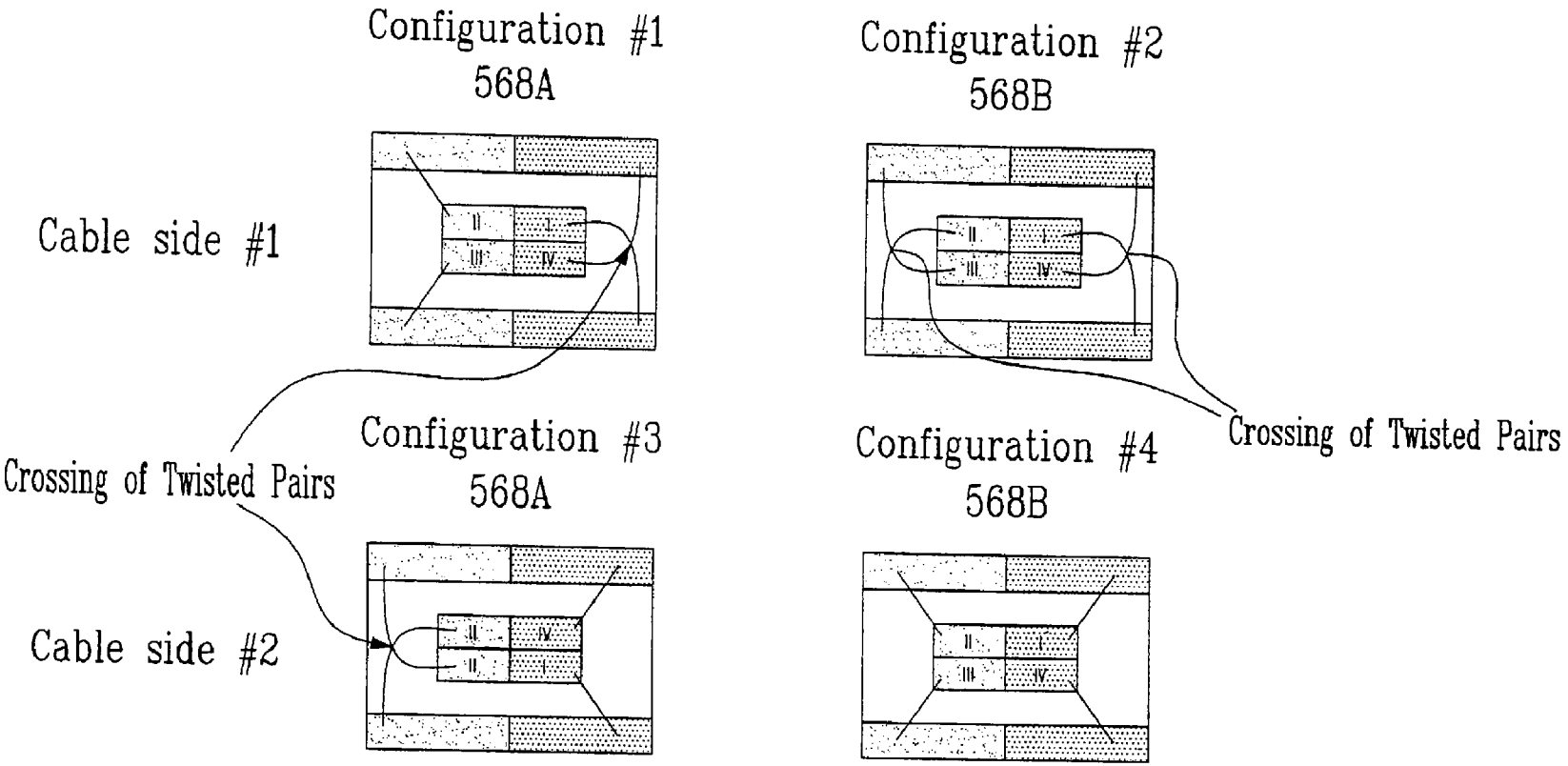
FIG. 6 is a schematic diagram illustrating the manner in which twisted pairs may become crossed during installation.

As stated above, NEXT is directly affected by the manner in which the cable 32 is terminated at that connector 10 and in particular NEXT can be introduced when the wires of different twisted pairs cross one another. Referring to FIG. 6, a schematic diagram of the various ways in which the wires 34 of a cable can be attached to a connector in accordance with ANSI/TIA/EIA-568A and 568B. Note that in FIG. 6 reference numeral I indicates blue, II orange, III green and IV brown. Different termination sequences can be obtained depending on the standard desired (T568A or T568B) and the end of the cable which is being connected. As is apparent from the diagram, three out of four possibilities involve the crossing of the wires of different twisted pairs which can give rise to unwanted NEXT.

It should also be pointed out that NEXT is also affected by the manner in which the individual twisted pairs are terminated. For example, the steps of unjacketing a portion of the cable to reveal the twisted pairs and untwisting the pairs in order to insert them in the slots 48 creates a loop opening. Effort should be made to reduce this untwisting towards a minimum.

It will now be apparent from the above that in order to ensure that every installation meets the requisite performance requirements as laid down in the applicable standards, it is necessary to proceed during attaching the wires 34 to the connector 10 using a rigorous and systematic approach. Therefore, the provision of any methods or tools which ensure that the installer proceeds in a systematic fashion can serve to greatly improve the performance of the installed interconnection.

Figure 7A:
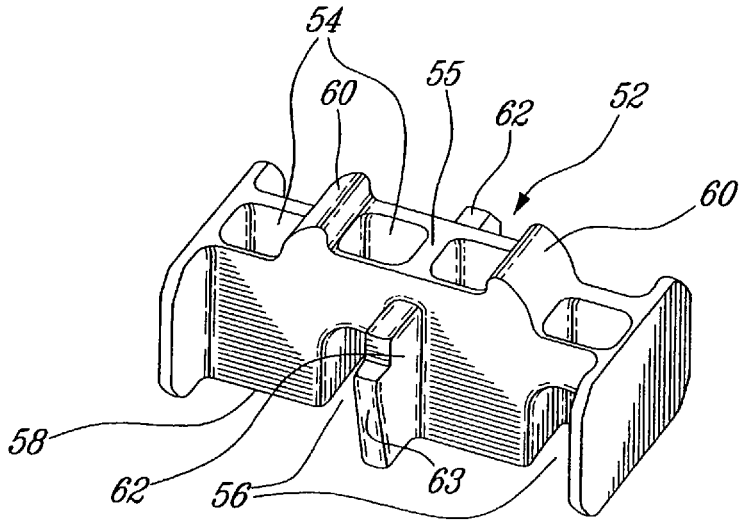
FIG. 7*a* is a perspective view of a wire lead guide in accordance with an illustrative embodiment of the present invention.
Figure 7B:
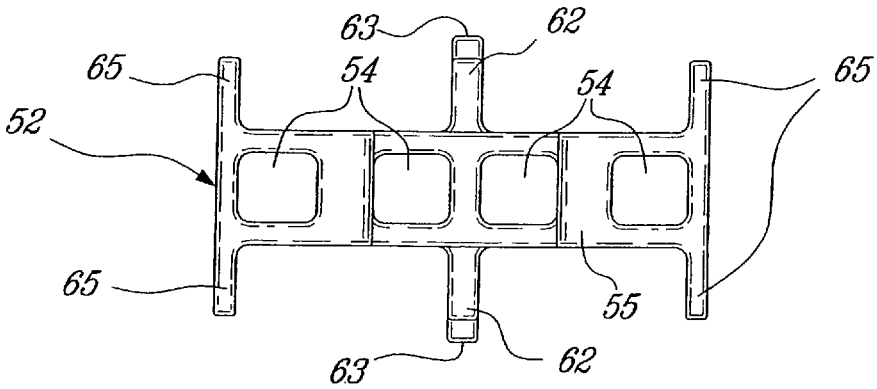
FIG. 7*b* is a side view of a wire lead guide in accordance with an illustrative embodiment of the present invention.
Figure 7C:
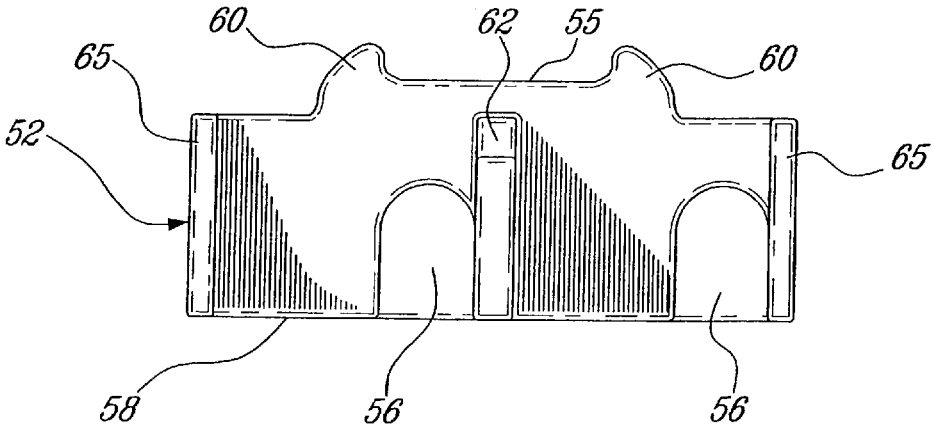
FIG. 7*c* is a side view (from above) of a wire lead guide in accordance with an illustrative embodiment of the present invention and FIG. 7*d* is a top plan view of a wire lead guide in accordance with a two piece illustrative embodiment of the present invention.

As stated above, NEXT is directly affected by the manner in which the cable is terminated, and arises when the wires of two pairs are crossed. Therefore, the ideal solution is to avoid crossing the pairs as the cable approaches the connector. Referring now to FIGS. 7*a*, 7*b* and 7*c*, in order to aid the installer during installation and prevent the crossing of the wires of different twisted pairs, regardless of the various configurations, a wire lead guide, generally referred to using the reference numeral 52, is inserted between the connector 10 and the cable 32 in order to maintain an advantageous spacing between the twisted pairs. In this manner, the wire lead guide 52 reduces variations in performance which may be introduced as the result pour quality installation practices, by imposing a uniform and systematic way of terminating the cable 32 on the connector 10.

In the present illustrative embodiment, the wire lead guide 52 comprises a guide body 53 and four (4) non-intersecting and generally parallel passageways 54 machined or cast, etc., through the upper surface 55 of the guide body 53 and into which the twisted pairs (not shown in FIG. 7*a*, 7*b* or 7*c*) can be inserted. The guide body 53 can be fabricated not only from a suitable rigid dielectric material such as plastic, but also cast from a shielding material such as metal (e.g. zinc or aluminium), a composite material or a ferromagnetic material. The twisted pairs exit the guide body 53 via a series of exits as in 56 machined, cast, etc., at right angles to and intersecting the passageways 54. Note that although the exits 56 are shown at right angles to the passageways 54, in a given embodiment the exits 56 could be at an angle to the passageways 54 different from right angle, depending on the style of the Referring back to FIG. 5, once the twisted pairs have been inserted through the passageways 54 in the guide body 53 and the wires of the twisted pairs are protruding out of their respective exits 56, the wire lead guide is inserted into the space 50 located between the opposing rows of slots 48 in the cover 24. It will be apparent now to one of ordinary skill in the art that the wires 34 of the twisted pairs which protrude from the exits are in position to intersect with the slots 48 into which they are then inserted.

Figure 10:
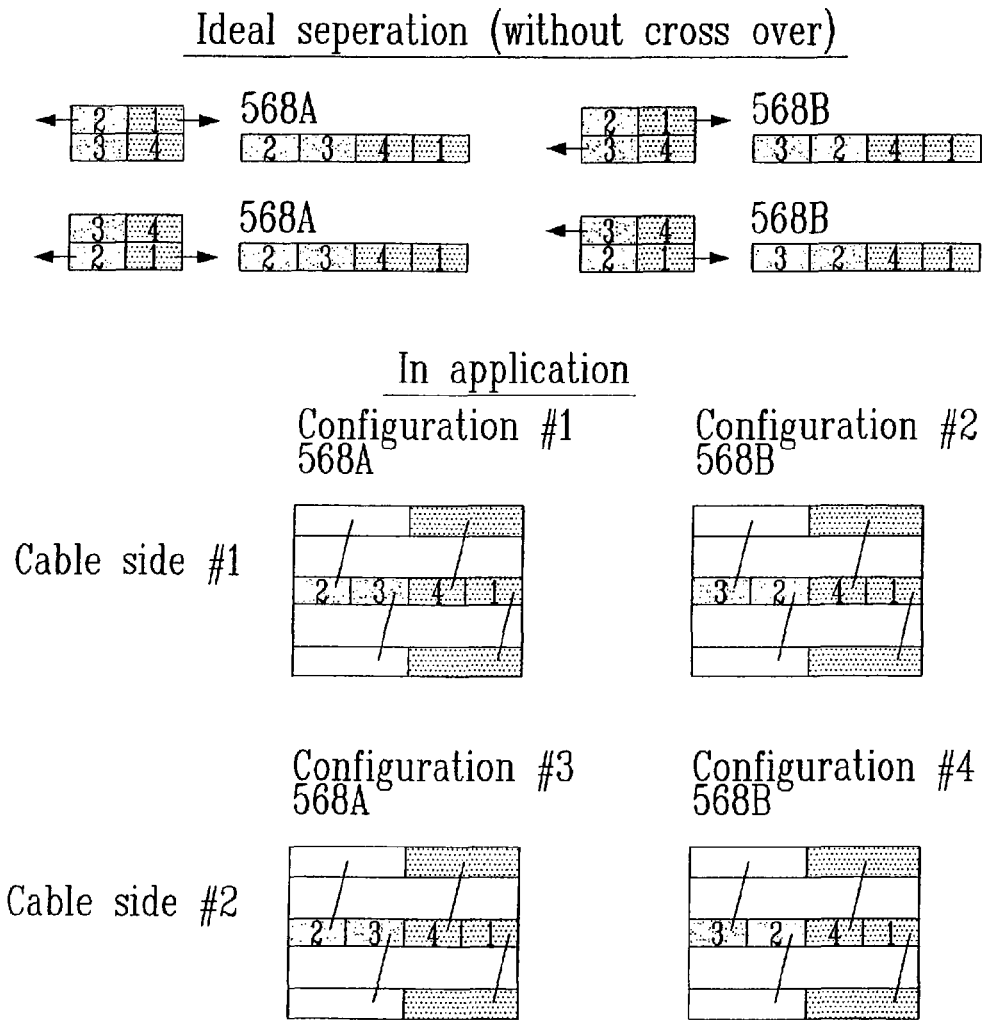
FIG. 10 is a schematic diagram illustrating the manner in which the twisted pairs should be arranged prior to insertion into the wire lead guide in accordance with an illustrative embodiment of the present invention.

Prior to inserting the twisted pairs through the passageways 54, however, the twisted pairs should first be aligned in the correct straight sequence such that no crossing of the pairs occurs. Referring to FIG. 10, a schematic diagram of the conversion from a round sequence (for a round cable) to a straight sequence is provided. It should be noted that in FIG. 10 the reference numeral 1 indicates the blue twisted pair, 2 indicates orange, 3 indicates green and 4 indicates brown.

Depending on the configuration, by moving the twisted pairs in the directions indicated by the arrows the correct align of the twisted pairs to avoid crossing can be achieved. Notice that although twisted pairs 2 (orange) and 3 (green) are inverted between the T568A and T568B schemes, no crossing of the wires of different twisted pairs occurs. It is rather a transposition from their respective vertical position to a horizontal position.

As stated above, the use of a wire lead guide 52 is not applicable to only the round UTP cables as commonly used. The same wire lead guide 52 may be used with other cables including both the Screened Twisted Pair (ScTP) or Shielded Twisted Pair (STP), in both round and flat configurations. Use of the wire lead guide 52 is also not limited by colour coding of the twisted pairs nor their sequence within the cable.

Referring back to FIGS. 7*a*, 7*b* and 7*c*, when using the wire guide 52 the installation method consists of exposing the end of the cable to reveal the twisted pairs, arranging the twisted pairs according to the correct sequence as shown in FIG. 10, sliding the wire lead guide 52 onto the twisted pairs until the upper surface 55 of guide body 53 abuts the with the end of the cable jacket 40, while maintaining the twisted pairs in the sequence according to FIG. 10. Once a sufficient amount of wire is exposed below the lower surface 58 of the guide body 53, the twisted pairs are bent perpendicularly such that they pass through their respective exits 56.

Still referring to FIGS. 7*a*, 7*b* and 7*c*, the four passageways 54 in the guide body 53 retain the twisted pairs in the correct sequence according to FIG. 10. The two raised abutments 60 serve to provide an increased separation between the external twisted pairs. The two dividing abutments 62 serve to better isolate the twisted pairs as they continue out of the exits 56 to their insertion points in the slots 48 thereby reducing crosstalk between them. Additionally, the outer edge of the dividing abutments 62 can be equipped with an angled flange 63 designed to snap fit with corresponding depressions (64 in FIG. 2) formed in the cover (24 in FIG. 2), thereby securing the guide 52. The outer walls 65 serve to better isolate the twisted pairs from exterior interference, especially in the that event another connector is installed in close proximity. This external crosstalk is generally known in the art as "alien crosstalk".

In an alternative illustrative embodiment the wire lead guide 52, with suitable modifications, could be integrated directly into the cover 24 of the interconnection module 22.

Figure 11:
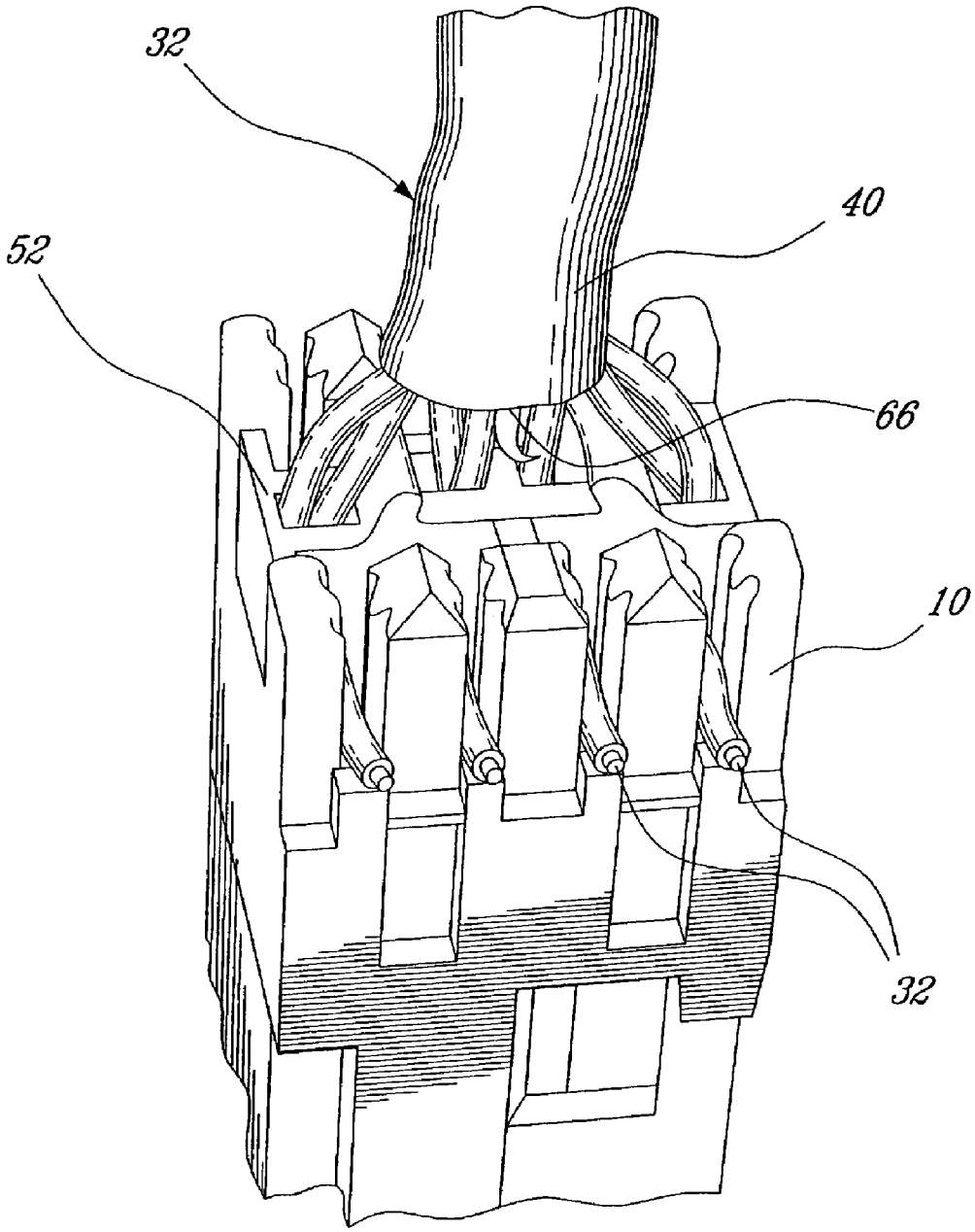
FIG. 11 is a perspective view of an assembled connector and cable with a wire lead guide interposed between the cabled end and the connector in accordance with an illustrative embodiment of the present invention.

Additionally, the wire lead guide 52 is designed in such a way to reduce the distance between the unjacketed section of the cable and the connection. Referring to FIG. 11, a UTP cable 32 terminated by a connector 10 using the wire lead guide 52 is disclosed. The bending of the wires as in 32 in the exits 56 prevents the untwisting of the pairs through the wire lead guide 32 and underneath the cable jacket 40. Therefore, the portion of each twisted pair which is untwisted may be reduced. Additionally, by forcing the wire lead guide 52 upwards such that the raised abutments 60 are inserted into a lower end 66 of the cable jacket 40, the cable jacket 40 will be held close to the connector 10 thereby exposing a reduced end portion of each twisted pair. This, combined with reducing the untwisting of the twisted pairs at the connector, can greatly improve the return loss, another important electrical parameter. Additionally, the raised abutments can be bonded to the lower end 66 of the cable jacket 40 using a suitable adhesive or welding technique to further improve the mechanical strength of the assembly. Furthermore, a tubular sleeve (not shown) can be mounted on a portion of the exposed end portions of each twisted pair to ensure that the amount of untwisting is reduced. The sleeve could be manufactured, for example, from a material which shrinks when heated.

Ensuring that twisted pairs are all of similar length also improves the mechanical strength of the interconnection by distributing the pulling force that might otherwise be applied to one twisted pair to all twisted pairs. Furthermore, the lower end 66 of the cable jacket 40 could be fastened to the wire lead guide 52 in region of the raised abutments 60, for example by using a suitable adhesive, thereby further improving the mechanical properties of the interconnection.

Figure 8:
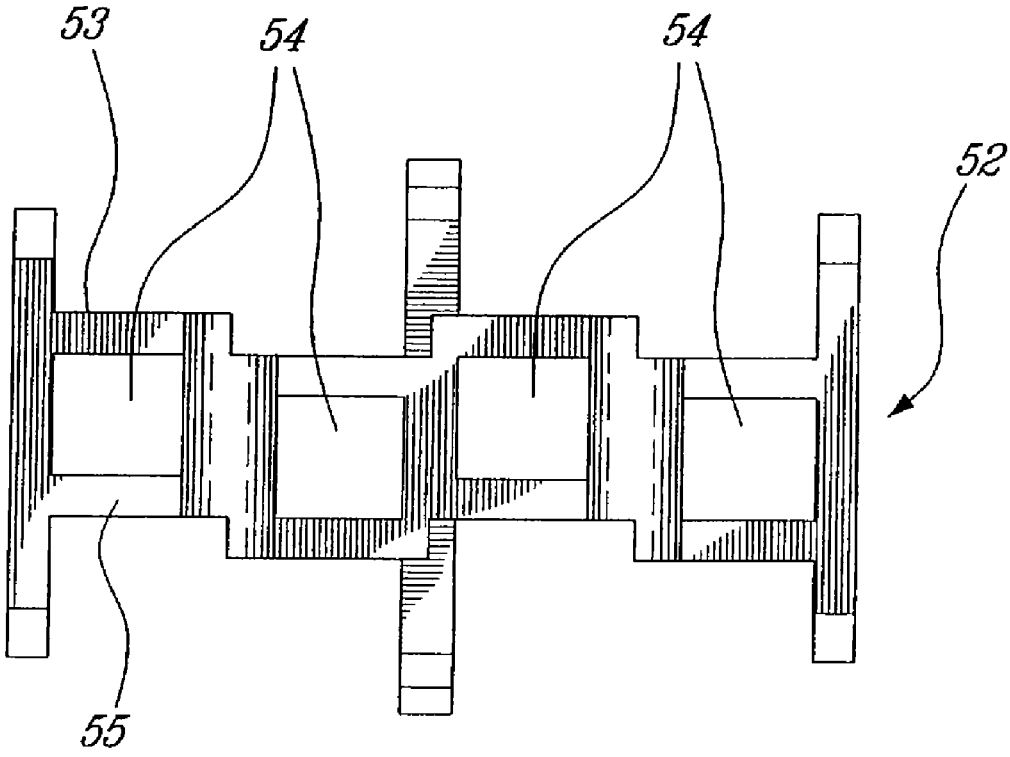
FIG. 8 is a top plan view of a wire lead guide in accordance with a first alternative illustrative embodiment of the present invention.
Figure 9A:
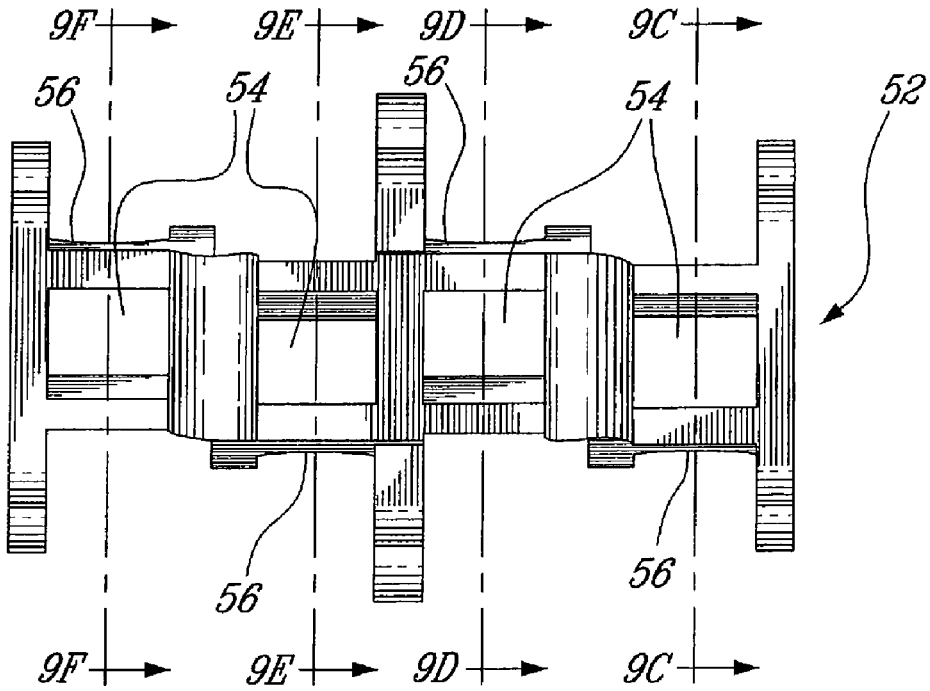
FIG. 9*a* is a top plan view of a wire lead guide in accordance with a second alternative illustrative embodiment of the present invention.
Figure 9B:
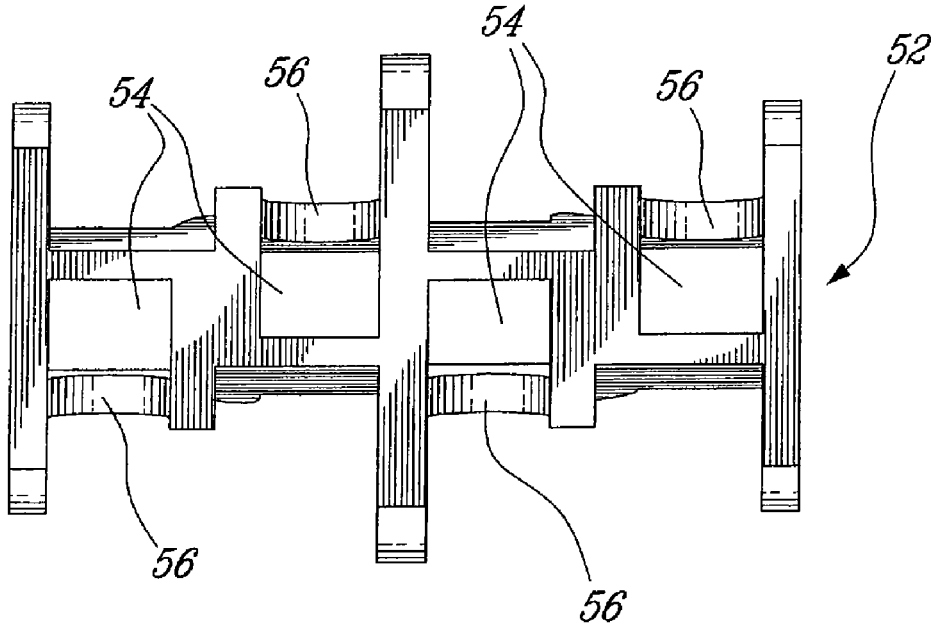
FIG. 9*b* is a bottom plan view of a wire lead guide in accordance with a second alternative illustrative embodiment of the present invention and FIGS. 9*c* through 9*f* provide a series of sectional views along lines 9*c* through 9*f* of the wire lead guide in FIG. 9*a;*
Figure 9C:
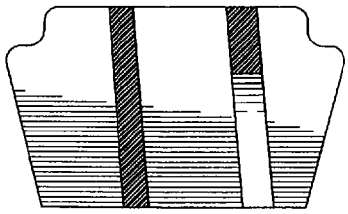
Figure 9D:
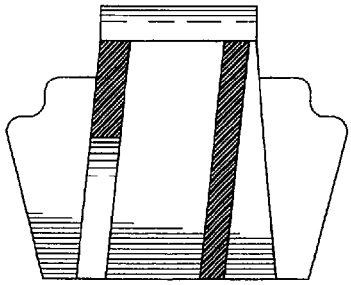
Figure 9E:
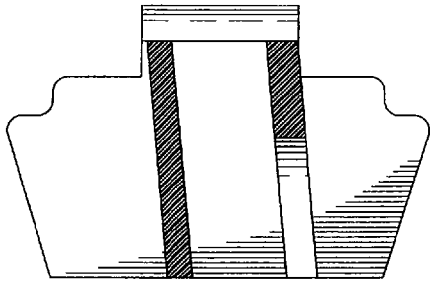
Figure 9F:
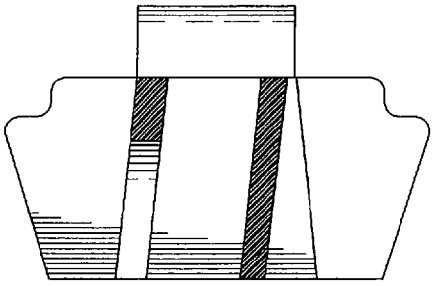

Referring now to FIG. 8, in a first alternative illustrative embodiment of the wire lead guide 52, the passageways 54 are not aligned along the upper surface 55 of guide body 53 but rather are in a staggered configuration. This provides for an improved performance on one hand by reducing the length of the exposed end portions of the twisted pairs.

Referring now to FIGS. 9*a* through 9*f*, in a second alternative illustrative embodiment of the wire lead guide 52, the non-intersecting passageways 54 do not run parallel to one another but rather slope towards their respective exits 56. This provides for an improved performance on one hand by reducing the length of the exposed end portions of the twisted pairs and also by ensuring that the end portions of successive twisted pairs are not in parallel, which in turns reduces the coupling between twisted pairs.

In brief, the wire lead guide 52 allows for a systematic installation of a connector following simple steps thereby optimising the installation time, the performance of the electrical transmission parameters as well as the mechanical strength of the installation.

For category 6 installations, TIA standards dictate that any mated connection must have less than −54 dB of crosstalk between pairs of twisted pairs. This value represents a ratio between the disturbed pair and the disturbing pair of 2 mV/V. Considering the phase of the signal, this represents a total range of + or −2 mV/V, thus a total range of 4 mV/V. Since the total assembly of a plug, a jack and the termination must meet the standards requirements, it is necessary to control the variation of each of these components in order to ensure Category 6 performance in all installations. In order to guarantee a minimum standard of performance, it is important to determine the range (between the minimum and maximum) within which the amount of cross talk between any pair of twisted pairs varies. If the range within which one of the plug, jack or termination elements can be reduced, the performance can be increased, or, alternatively, the requirements on the other elements can be relaxed.

A series of comparative tests were performed on a series of like cables terminated by different installers in a conventional fashion and terminated using a wire lead guide 52. Table 1 provides results for the cross talk between pairs of twisted pairs at 100 MHz where the cables were terminated in a conventional fashion by a number of different installers:

TABLE 1

| Pair | 1-2 | 1-3 | 1-4 | 2-3 | 2-4 | 3-4 |
|---|---|---|---|---|---|---|
| Mean | 1.1350 | 0.6900 | 0.5840 | 1.2419 | 0.6094 | 0.2239 |
| St. Dev. | 0.2136 | 0.3177 | 0.1986 | 0.9315 | 0.2132 | 0.2083 |
| Range | 0.6446 | 1.1780 | 0.5754 | 2.9248 | 0.6089 | 0.5330 |
| Minimum | 0.8780 | 0.3224 | 0.3023 | 0.2843 | 0.3858 | 0.0333 |
| Maximum | 1.5226 | 1.5004 | 0.8777 | 3.2091 | 0.9947 | 0.5663 |
| Count | 10 | 10 | 10 | 10 | 10 | 10 |

Table 2 provides results for the cross talk between pairs of twisted pairs at 100 MHz where the cables were terminated using a wire lead guide by a number of different installers:

TABLE 2

| Pair | 1-2 | 1-3 | 1-4 | 2-3 | 2-4 | 3-4 |
|---|---|---|---|---|---|---|
| Mean | 1.1613 | 0.5423 | 0.5503 | 0.6457 | 0.4926 | 0.1521 |
| St. Dev. | 0.1319 | 0.1069 | 0.2525 | 0.1788 | 0.0937 | 0.0898 |
| Range | 0.5602 | 0.3687 | 0.9885 | 0.6935 | 0.3667 | 0.2949 |
| Minimum | 0.7870 | 0.3583 | 0.1815 | 0.3162 | 0.3477 | 0.0284 |
| Maximum | 1.3472 | 0.7270 | 1.1699 | 1.0097 | 0.7144 | 0.3233 |
| Count | 20 | 20 | 20 | 20 | 20 | 20 |

In the above tables:

Mean is the average cross talk in mV/V over the number of assemblies tested;

St. Dev. Is the standard deviation of the cross talk over the number of assemblies tested;

Range is the difference between the maximum crosstalk of all assemblies tested and the minimum cross talk of all the assemblies tested;

Minimum is the minimum cross talk of all the assemblies tested;

Maximum is the maximum cross talk of all the assemblies tested; and

Count is the number of assemblies tested.

Looking at the tables, it is apparent that over a large number of assemblies, the range in levels of cross talk between pairs of twisted pairs was decreased below 1 mV/V for those terminated using the wire lead guide, as opposed to those terminated in a conventional manner where the range was in one case close to 3 mV/V.

Other advantages are also associated with the wire lead guide 52. For example, the wire lead guide 52 may be fastened to the connector assembly 10, for example using a suitable adhesive or by the provision of a snap fitting, whereby it will provide additional mechanical support thereby improving cable retention and reducing negative effects related to the manipulation of the cable (for example, excessive bending). Given its compact dimension, the wire lead guide 52 can also be easily integrated into existing designs. The wire lead guide 52 may also be used on a connector assembly 10 during a mated performance qualification session, to eliminate the variance related to the installation.

Figure 7D:
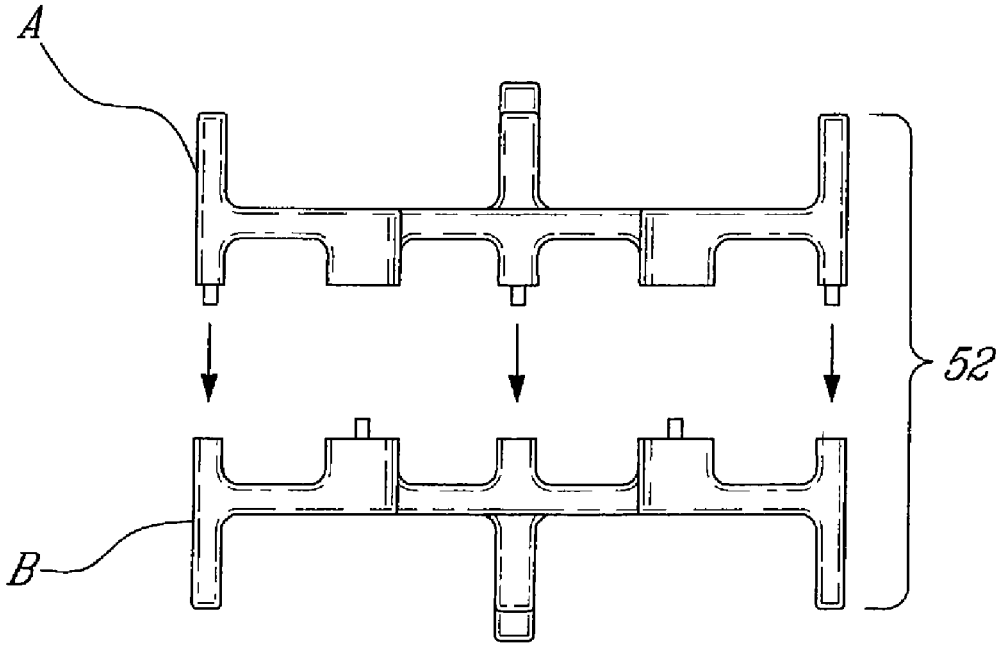

A number of other variations to the wire lead guide 52 can also be foreseen. For example, referring to FIG. 7*d*, the wire lead guide 52 can be modified to be adapted to an already installed cable without removing the connections, for example by dividing the wire lead guide 52 longitudinally into two (or more) separate parts which clip together around the twisted pairs.

Additionally, the basic concept of the wire lead guide 52 can be easily adapted for use on a number of different connector types including those where the slots 48 are arranged in four straight pairs, two rows of two pairs, etc., by simply modifying the location of the exits 56. Furthermore, it is not necessary that the passageways 54 be linearly aligned as illustrated in the figures. The passageways 54 could, for example, alternatively be arranged in a square pattern (i.e. with four twisted pairs in a 2 by 2 arrangement) provided the exits 56 are aligned in order to maintain the requisite arrangement. Also, the device can be used in conjunction with a termination (punch) tool or it can be adapted to a "tool-less" connector, where pressure ensures the contact. Regarding the tool-less connector, the wire lead guide could be integrated into the presscap (not shown), with the twisted pairs being arranged in the presscap such that, on mounting of the presscap to an interconnection module 22 equipped with self cutting contacts (not shown), interconnection is made between the individual conductors of each twisted pair and their corresponding contact.

Additionally, different materials could be used to optimise the performance of the wire lead guide 52. For example, in order to provide enhanced electrical shielding properties it is possible to fabricate the wire lead guide 52 from a metallic material such as zinc or from a composite material containing some conductive material, such as ferromagnetic particles.

Although the present invention has been described hereinabove by way of an illustrative embodiment thereof, this embodiment can be modified at will without departing from the spirit and nature of the subject invention.

What is claimed is:

1. A method for terminating a telecommunications cable, the cable comprising four twisted pairs of wires arranged in a generally parallel relationship to a common axis, each of the twisted pairs having an exposed end portion, the method comprising:

providing an interconnection module comprising four pairs of substantially flat Insulation displacement contact IDC terminals, a corresponding one of said four pairs of Insulation displacement contact IDC terminals for terminating each of the twisted pairs, wherein each Insulation displacement contact IDC terminal of each pair of said four pairs of Insulation displacement contact IDC terminals lie in the same plane;

aligning the end portions; and interconnecting each of the aligned end portions with said corresponding pair of Insulation displacement contact IDC terminals;

wherein said aligning the end portions comprises arranging the end portions such that when connected to their corresponding Insulation displacement contact IDC terminal pairs, said twisted pairs remain uncrossed.

2. The method of claim 1, further comprising, prior to interconnecting each of the aligned end portions:

providing a wire lead guide comprising of a guide body defining a plurality of non-intersecting passageways; and inserting each of said end portions through a corresponding one of said passageways.

3. The method of claim 2, further comprising four non-intersecting passageways through said body and further wherein each of said end portions is inserted through a dedicated one of said passageways.

4. The method of claim 1, wherein each of said terminals comprises a bifurcated contact plate and interconnecting each of the aligned end portions comprises inserting said aligned end portions into said bifurcation.

5. The method of claim 1, wherein the aligned end portions lie substantially in the same plane.

6. The method of claim 4, wherein the end portions are bent substantially at right angles to the common axis prior to interconnecting each of the aligned end portions.

7. The method of claim 1, wherein said terminals are arranged in two substantially parallel and aligned rows of terminals and wherein interconnecting each of the aligned end portions further comprises connecting every second of the aligned end portions to a pair of terminals in a different row.

8. The method of claim 1, wherein said terminals are arranged in two substantially parallel rows of two pairs of terminals each, said rows defining an insertion region there between, and further comprising positioning the aligned end portions in said insertion region prior to interconnecting each of the aligned end portions.

9. The method of claim 1, wherein said end portions are aligned such that adjacent end portions are connected with pairs of terminals in different rows.

10. The method of claim 1 wherein each of the twisted pairs is coded with a colour selected from the group consisting of blue, orange, green and brown and wherein each of said pairs of terminals is colour coded with a colour selected from the group consisting of blue, orange, green and brown, each of said colour coded pairs of terminals for interconnection with the twisted pair having the same colour code.

11. The method of claim 10, wherein said colour coded pairs of terminals are arranged such that said green coded pair of terminals and said brown coded pair of terminals are on a first side of said insertion region and said orange coded pair of terminals and said blue coded pair of terminals are on an opposite side of said insertion region, said orange coded pair of terminals being opposite said green coded pair of terminals and said brown coded contact pair being opposite said blue coded contact pair and wherein the twisted pairs are distributed in an ordered sequence of blue, orange, green and brown around the common axis, and aligning the end portions further comprises arranging the end portions such that blue is adjacent to brown and green is adjacent to orange.

12. The method of claim 11, wherein aligning the end portions further comprises arranging the end portions in the order green, orange, brown then blue.

13. The method of claim 10, wherein said colour coded pairs of terminals are arranged such that said orange coded pair of terminals and said brown coded pair of terminals are on a first side of said insertion region and said green coded pair of terminals and said blue coded pair of terminals are on an opposite side of said insertion region, said orange coded pair of terminals being opposite said green coded pair of terminals and said brown coded pair of terminals being opposite said blue coded pair of terminals and wherein the twisted pairs are distributed in an ordered sequence of blue, orange, green and brown around the common axis, and aligning the end portions further comprises arranging the end portions such that blue is adjacent to brown and green is adjacent to orange.

14. The method of claim 13, wherein aligning the end portions further comprises arranging the end portions in the order orange, green, brown then blue.

15. The method of claim 1, wherein the cable is a Unshielded Twisted Pair UTP cable.

16. The method of claim 1, wherein the cable is selected from the group consisting of Unshielded Twisted Pair cables UTP cables, Screened Twisted Pair ScTP cables and flat cables.

17. The method of claim 1, wherein the cable is selected from the group consisting of round cables and flat cables.

18. The method of claim 1, further comprising mounting a sleeve over each of the end portions prior to interconnecting each of the aligned end portions.

* * * * *